US008272110B2

(12) United States Patent
Valenzuela

(10) Patent No.: US 8,272,110 B2
(45) Date of Patent: Sep. 25, 2012

(54) SHOE LACE

(75) Inventor: Dora Ann Valenzuela, Mission Hills, CA (US)

(73) Assignee: Dora Valenzuela, Mission Hills, CA (US)

( * ) Notice: Subject to any disclaimer, the term of this patent is extended or adjusted under 35 U.S.C. 154(b) by 0 days.

(21) Appl. No.: 11/394,867

(22) Filed: Mar. 31, 2006

(65) Prior Publication Data

US 2007/0226968 A1 Oct. 4, 2007

(51) Int. Cl.
*A43C 9/04* (2006.01)

(52) U.S. Cl. ..... 24/715.7; 24/715.4; 24/713.1; 36/50.1

(58) Field of Classification Search ..... 24/712, 24/713.1, 715.4, 715.5, 715.7; 36/50.1
See application file for complete search history.

(56) References Cited

U.S. PATENT DOCUMENTS

| | | | | | |
|---|---|---|---|---|---|
| 579,943 | A * | 3/1897 | Kempshall | ..... | 24/715.4 |
| 1,179,191 | A * | 4/1916 | Kempshall | ..... | 24/715.4 |
| 2,036,482 | A * | 4/1936 | Larson | ..... | 24/715.3 |
| 2,145,476 | A * | 1/1939 | Dennis | ..... | 24/715.4 |
| 5,832,574 | A * | 11/1998 | Shin | ..... | 24/712.1 |
| 6,026,548 | A * | 2/2000 | Jackson | ..... | 24/712 |
| 6,167,599 | B1 * | 1/2001 | Chen | ..... | 24/715.4 |
| 6,427,298 | B1 * | 8/2002 | Tseng | ..... | 24/715.4 |
| 6,493,910 | B1 * | 12/2002 | Dischler | ..... | 24/712 |

* cited by examiner

*Primary Examiner* — Robert J Sandy
(74) *Attorney, Agent, or Firm* — Dora Valenzuela

(57) ABSTRACT

The present invention is directed to an improved shoe lace comprised of a plurality of bendable support elements permanently held within a limp material at each of the two end tips by a sleeve, whereby the lace enables children, and persons with physical disabilities, to more easily tie their shoes, as well as staying tied while wearing the improved shoe laces.

11 Claims, 3 Drawing Sheets

SHOE LACE

FIELD OF INVENTION

This invention relates, generally to shoe laces; more particularly to shoe laces that make it easier for children, and individuals who are physically challenged, to tie their shoes.

BACKGROUND

It has long been known that children often have trouble learning to tie their shoe laces because they do not possess the fine motor skills required. But even when they learn how to tie their shoe laces, they are often too lazy about how the shoe laces are tied. Such an attitude has led many to choose slip-ons, causal shoes, and shoes that have hook and eye straps instead of conventional tie up shoes.

Still, there are advantages to having shoe laces, and like it or not, children will be asked to tie shoe laces for the foreseeable future. Other than children, there is a need for shoe laces that are easier to tie by people who are either handicapped, or physically limited. For instance, people suffering with arthritis in their hands, or victims of stroke, may find it difficult, and uncomfortable to tie conventional shoe laces.

U.S. Pat. No. 579,943 disclosed a shoe lace composed of a sheath and core. However, because the shoe lace core is made of a non-metallic material, it is not easy to manipulate. U.S. Pat. No. 4,721,468 entitled "Training Shoelace" describes a shoe lace that has markings on the outside, and opposite end portions that are just stiff enough to retain the shape to which they are bent while permitting a child or handicapped person to easily bend them during the tying of a bow. Similarly, U.S. Pat. No. 4,842,522 discloses a shoe lace on which the opposite end portions are just stiff enough to substantially retain its shape. But because both of these patents rely on using just a single piece of uncoated copper wire as the lace core, these laces are more easily prone to breakage and can pierce the sheath making the shoe lace unsafe.

Accordingly, there is a long-felt need for an improved shoe lace that can be used easily by children, and persons with physical disabilities, to tie their shoes. There is also a need for an improved shoe lace that does not contain different markings, or mechanisms, on the outer sheath of the shoe lace, because such markings will only confuse these individuals once they have learned, and started using a conventional shoe lace.

SUMMARY OF THE INVENTION

This invention is directed towards overcoming the above shortcomings by disclosing a shoe lace having a plurality of bendable support elements permanently held within a limp material at each of the two end tips by an anchor.

In another embodiment of the invention, a shoe lace of the present invention is comprised of a plurality of bendable support elements permanently held within a limp material at each of the two end tips by a sleeve, wherein the limp material is made of fabric, wherein the limp material is cylindrical in shape, wherein the sleeve is made of metal, and wherein the support elements are comprised of three coated and fused wires.

In yet another embodiment of the invention, a shoe lace of the present invention is comprised of a plurality of bendable support elements permanently held within a limp material at each of the two end tips by a sleeve, wherein the limp material is made of fabric, wherein the limp material is cylindrical in shape, wherein the sleeve is made of plastic, and wherein the support elements are comprised of three coated and fused wires.

In a further embodiment of the invention, a method for assisting individuals to use shoe laces, is comprised of threading an improved shoe lace, comprising of a plurality of bendable support elements permanently held within a limp material at each of the two end tips by a sleeve, through a plurality of eyelets of a shoe, and tying said shoe lace ends together.

In another construction of the invention, an improved shoe lace is made by inserting a plurality of bendable support elements into a pre-selected length of a limp material with two end tips; securing the support elements to an metal anchor at each of the ends; permanently securing each anchor to the limp material to form a shoe lace with two metal end tips; whereby the two anchors hold the support elements within the limp material such that the support elements cannot be removed without removing the two end tips from the shoe lace.

In yet another construction of the invention, an improved shoe lace is made by weaving a limp material over a plurality of bendable support elements, so that the limp material completely covers the elements, inserting the ends of the limp material, containing the support elements, through a plastic sleeve, securing, permanently each plastic sleeve to the limp material to form a shoe lace with two plastic end tips; whereby the two sleeves hold the support elements within the limp material such that the support elements cannot be removed without first removing the two end tips from the shoe lace.

An advantage of the invention is that the invention is inexpensive and easy to use.

A further advantage is that the shoe lace is more resilient to breaking.

The foregoing, and other features and advantages of the invention, will be apparent from the following more particular description of the preferred embodiments of the invention, the accompanying drawings, and the claims.

DRAWINGS—REFERENCE NUMERALS

Figure 2:
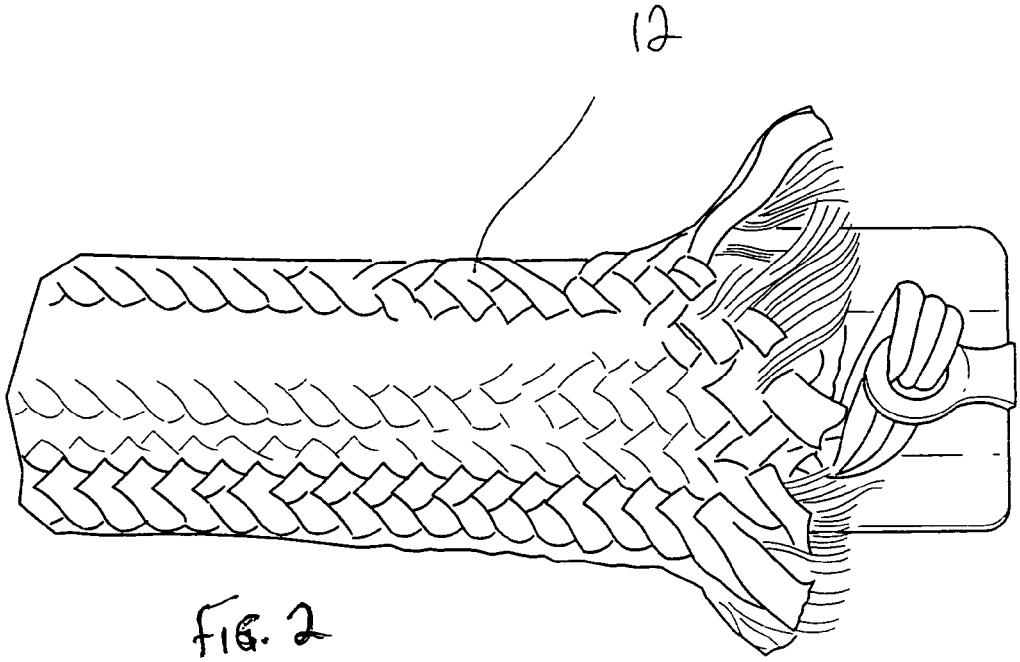
FIG. 2 illustrates a limp material enclosing support elements connected to a metal sleeve of the first embodiment.

10 improved shoe lace
12 limp material
14 bendable support elements
16 anchor
18 metal sleeve
20 eyelet
22 metal tip
24 plastic sleeve
26 plastic tip
28 first wing
30 second wing
32 bent back eyelet

DETAILED DESCRIPTION OF THE DRAWINGS

Figure 1:
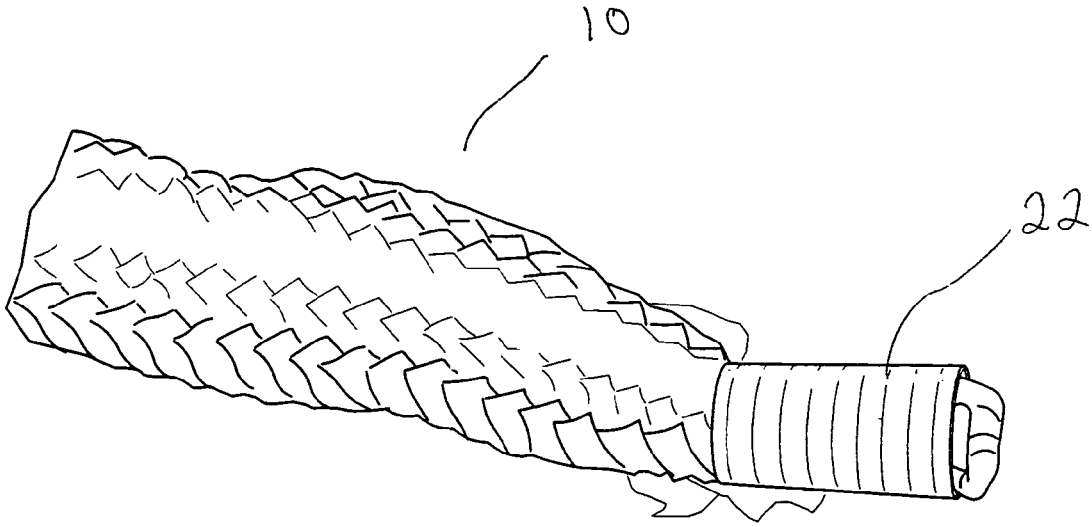
FIG. 1 illustrates the first embodiment of the invention.

FIG. 1 shows the improved shoe lace 10. The shoe lace has a limp material that represents the outer shoe lace component 12. The limp material 12 is made of fabric, cloth, leather, or another suitable material capable of providing a limp quality. The limp material can be multi-colored, uniformly colored, or a combination thereof. The material can also be cylindrical or flat in shape with a cylindrical tip (see below).

Figure 4:
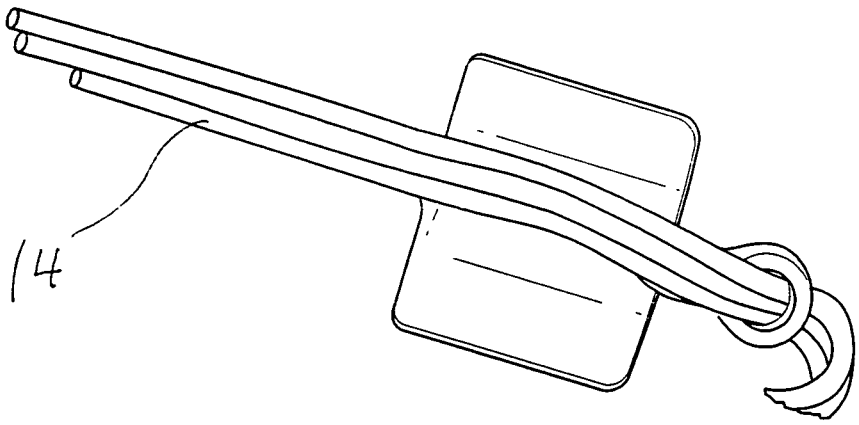
FIG. 4 illustrates support elements inserted through the eyelet of the first embodiment of the invention.
Figure 3:
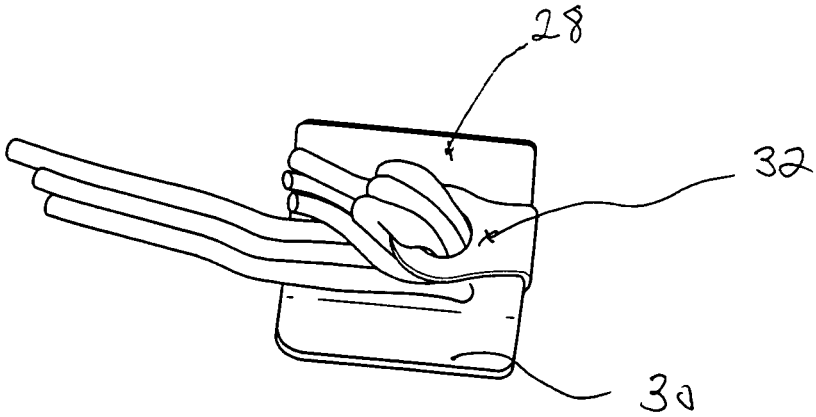
FIG. 3 illustrates support elements connected to the metal sleeve of the first embodiment of the invention.

A plurality of bendable support elements 14 are inserted into the limp material 12. In the preferred embodiment (see FIG. 4), the bendable support elements are represented by three fused wires 14. Multiple, rather than a single, wires are preferable because their combination provides increased strength and rigidity. Nevertheless, whatever the number of fused wires chosen, the bendable support elements 14 should be sufficiently stiff enough such that the shoe lace will retain its position while it is being tied and not being held, and the total diameter should not exceed ⅛ inch in order that the support elements and limp material fit through the shoe eyelets. In this regard, reference is made to U.S. Pat. No. 4,721,468, the disclosure of which is specifically incorporated herein by reference, which discusses the diameter thickness of wire sufficient for this purpose. The wires can be made of copper, steel, aluminum, alloy, or any combination thereof. In addition, the wires can be coated in plastic by processes well known to those skilled in the art at this time. In another embodiment, the multiple coated wires are fused together. It should also be understood that rather than using metal wires, some other type of bendable material with a memory, such as plastic, may be used in an alternative preferred embodiment.

Figure 7:
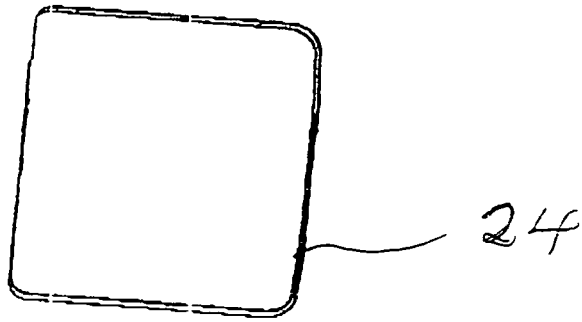
FIG. 7 illustrates a plastic sleeve of the second embodiment of the invention.

Two embodiments of the present invention are shown. FIGS. 1-5 show the embodiment of the invention where a metal sleeve is used to connect the limp material to the support elements; whereas FIGS. 6-7 show an embodiment when a plastic sleeve is used to connect the limp material to the support elements.

Figure 5:
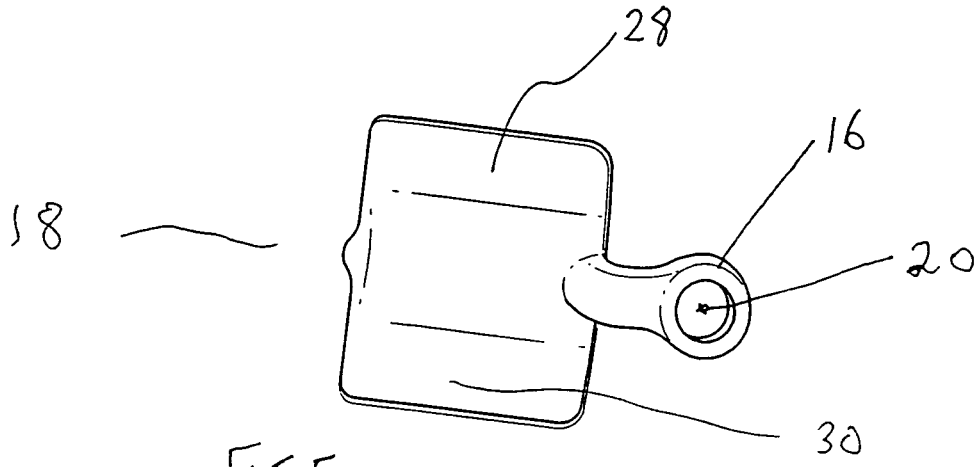
FIG. 5 illustrates a metal sleeve of the first embodiment of the invention.
Figure 6:
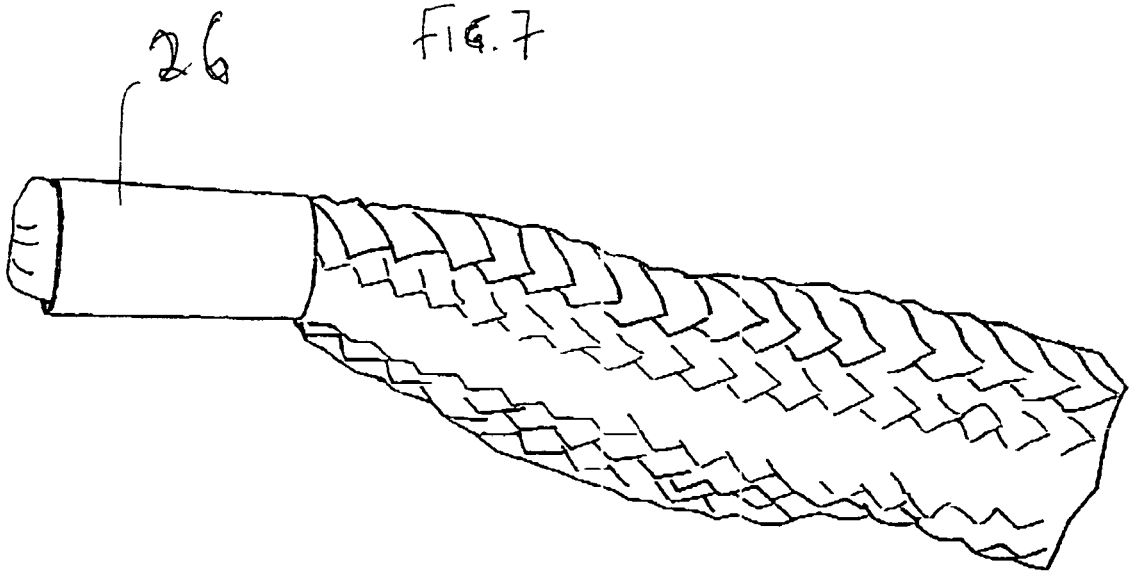
FIG. 6 illustrates the second embodiment of the invention.

In the first embodiment of the invention, a metal sleeve 18 is used (see FIG. 5). Here, the bendable support element is inserted through an eyelet 20 present on the tip of an anchor 16 integrally part of the metal sleeve 18 (see FIG. 4). Each of the bendable support elements ends are then permanently secured to the anchor 16 (see FIG. 3) by methods will known to those skilled in the art, including tying a knot using the bendable element end and the metal eyelet 20. Once the support elements 14 have been secured to the eyelet 20, eyelet 20 is bent towards the metal sleeve 18 (see FIG. 3). This bending process can be performed using a tool.

Next, in this preferred embodiment, the limp material 12 is weaved over the bendable support elements 14 so that the limp material 12 completely surrounds the bendable support elements 14 (see FIG. 5). Such a process could be accomplished by the manufacturer. Alternatively, the limp material 12 could be formed such that it has a space inside of it designed for insertion of the bendable support elements 14, or the limp material 12 could be formed around the bendable support elements 14. However, it is believed that neither of these methods is as cost efficient as the preferred method.

Once the limp material is weaved over the bendable support elements 14, the first wing 28 of the metal sleeve is folded over the limp material (containing the bendable support elements), and then the second wing 30 of the metal sleeve is folded over the first wing, and the metal sleeve is then compressed together, using a tool, to finally form the metal shoe lace tip 22. In the preferred embodiment, the metal sleeve is crimped to the limp material (see FIG. 1)

In the second embodiment of the invention, a plastic sleeve 24 (see FIG. 7) is used. Here the limp material is weaved over the bendable support elements, so that the limp material completely surrounds the bendable support elements. In the preferred embodiment, the limp material, containing the bendable elements, is inserted through a plastic sleeve, and then secured permanently by heat or pressure to form a plastic shoe lace tip. In an alternate embodiment, the limp material is placed on the plastic sleeve, whereupon the plastic sleeve is then folded over to fully surround the limp material. The sleeve is then secured into position by heating, or applying pressure to, the plastic sleeve so that it becomes fused with the limp material (see FIG. 6).

It is especially preferred that the support elements 14 are held within the limp material 12 and secured to the tips (whether metal or plastic), such that the support elements 14 are not exposed and cannot be removed from shoe lace 12 without first removing the end tips 22, or 26. This is accomplished primarily by the method in which the support elements 14 are secured, whether crimped or fused, to the tips 22 or 26, respectively, but also by controlling the thickness of both the limp material 12 and support elements 14 chosen, and the procedure by which the limp material 12 is weaved over the support elements 14.

It should be understood that the invention has application far beyond the exemplary embodiments presented and described herein, and as such is not to be limited to those embodiments. In addition, the invention is not limited to the particular physical configuration, but instead is adaptable. All changes, modifications, variations, and other uses and applications which do not depart from the spirit and scope of the invention are deemed to be covered by the invention.

What is claimed is:

1. In a shoe lace having a pre-selected length of a limp material with two end tips for use in tying a shoe, the improvement comprising:

a plurality of bendable support elements permanently held within the limp material at each of the two end tips by a sleeve, and an anchor attached to and extending from the sleeve, the anchor permanently securing the bendable support elements thereto.

2. The shoe lace as recited in claim 1, wherein the limp material is made from a material selected from the group consisting of fabric, cloth, and leather.

3. The shoe lace as recited in claim 2, wherein the limp material is a shape selected from a group consisting of cylindrical and flat.

4. The shoe lace as recited in claim 3, wherein the sleeve is made of metal.

5. The shoe lace as recited in claim 4, wherein the support elements are comprised of three coated and fused wires.

6. The shoe lace as recited in claim 5, wherein said limp material has only one uniform color.

7. The shoe lace as recited in claim 5, wherein said limp material has a plurality of colors.

8. The shoe lace as recited in claim 4, wherein said limp material has only one uniform color.

9. The shoe lace as recited in claim 4, wherein said limp material has a plurality of colors.

10. In a shoe lace having a pre-selected length of a limp material with two end tips for use in tying a shoe, the improvement comprising:

a plurality of bendable support elements permanently held within the limp material at each of the two end tips by a sleeve, wherein the limp material is made of fabric, wherein the limp material is cylindrical in shape, wherein the sleeve is made of metal, and wherein the support elements are comprised of three coated and fused wires, and an anchor attached to and extending from the sleeve, the anchor permanently securing the bendable support elements thereto.

11. In a shoe lace having a pre-selected length of a limp material with two end tips for use in tying a shoe, the improvement comprising:

a plurality of bendable support elements permanently held within the limp material at each of the two end tips by a sleeve, wherein the limp material is made of fabric, wherein the limp material is cylindrical in shape, wherein the sleeve is made of metal, wherein the support elements are comprised of three coated and fused wires, and an anchor attached to and extending from the sleeve, the anchor permanently securing the bendable support elements thereto.

* * * * *